US011040438B2

(12) United States Patent
Gottschling

(10) Patent No.: US 11,040,438 B2
(45) Date of Patent: Jun. 22, 2021

(54) HAMMER DRILL

(71) Applicant: Black & Decker Inc., New Britain, CT (US)

(72) Inventor: Rafael Gottschling, Selters-Eisenbach (DE)

(73) Assignee: Black & Decker Inc., New Britain, CT (US)

( * ) Notice: Subject to any disclaimer, the term of this patent is extended or adjusted under 35 U.S.C. 154(b) by 153 days.

(21) Appl. No.: 16/516,885

(22) Filed: Jul. 19, 2019

(65) Prior Publication Data

US 2020/0039048 A1 Feb. 6, 2020

(30) Foreign Application Priority Data

Jul. 31, 2018 (GB) ..... 1812437

(51) Int. Cl.

| | |
|---|---|
| ***B25D 9/26*** | (2006.01) |
| ***B25D 11/12*** | (2006.01) |
| ***B25D 17/06*** | (2006.01) |
| ***B25D 17/24*** | (2006.01) |

(52) U.S. Cl.

CPC ..... *B25D 9/26* (2013.01); *B25D 11/12* (2013.01); *B25D 17/06* (2013.01); *B25D 17/24* (2013.01); *B25D 2250/371* (2013.01)

(58) Field of Classification Search

CPC ..... B25D 9/26; B25D 11/12; B25D 17/06; B25D 17/24

USPC ..... 173/201, 211, 212, 210, 109

See application file for complete search history.

(56) References Cited

U.S. PATENT DOCUMENTS 2,872,914 A * 2/1959 Fahrni ..... B25D 11/068 173/100
3,850,255 A * 11/1974 Koehler ..... B25D 16/003 173/110
4,442,906 A * 4/1984 Simpson ..... B25D 17/06 173/48

(Continued)

FOREIGN PATENT DOCUMENTS

DE 3628716 A1 2/1988
DE 19958420 A1 6/2001

(Continued)

OTHER PUBLICATIONS

EP ESSR dated Sep. 12, 2019 in co-pending EP application 19164264.

(Continued)

*Primary Examiner* — Nathaniel C Chukwurah
(74) *Attorney, Agent, or Firm* — Amir R. Rohani

(57) ABSTRACT

A hammer drive mechanism for a hammer strike mechanism of a hammer drill is provided including: a drive shaft capable of being rotationally driven by a motor, a rod capable of reciprocatingly driving a piston, and a conversion mechanism that converts the rotary movement of the drive shaft into a reciprocating movement of the rod. The drive shaft comprises a first part connected to the conversion mechanism and a second part capable of being rotationally driven by a motor. The second part connects to the first part via at least one dampener such that rotary movement of the second part is transferred to the first part via the at least one dampener.

20 Claims, 8 Drawing Sheets

(56) References Cited

U.S. PATENT DOCUMENTS

| | | | | |
|---|---|---|---|---|
| 2006/0156860 | A1* | 7/2006 | Arich | B25D 17/26<br>74/606 R |
| 2013/0199810 | A1 | 8/2013 | Wyler | |
| 2016/0339577 | A1 | 11/2016 | Takeuchi et al. | |

FOREIGN PATENT DOCUMENTS

| | | | |
|---|---|---|---|
| DE | 102007035699 | A1 | 2/2009 |
| EP | 3178609 | B1 | 6/2019 |
| GB | 2421464 | A | 6/2006 |
| JP | 2003245873 | A | 9/2003 |

OTHER PUBLICATIONS

GBSR dated Jan. 15, 2019 in corresponding GB application 1812437.0.

* cited by examiner

HAMMER DRILL

CROSS-REFERENCE TO RELATED APPLICATIONS

This application claims priority, under 35 U.S.C. § 119, to UK Patent Application No. 18 124 37.0 filed Jul. 31, 2018.

FIELD

The present invention relates to a hammer drill.

BACKGROUND

Hammer drills are capable of supporting a cutting tool in a tool holder and comprise a hammer strike mechanism which reciprocatingly strikes the rear end of the cutting tool to repetitively urge the cutting tool forward in a direction parallel to the longitudinal axis of the cutting tool. The hammer strike mechanism typically comprises a cylinder in which is mounted a piston which can be reciprocatingly driven by a hammer drive mechanism which translates the rotary drive of a motor to a reciprocating drive of the piston. A ram, also slideably mounted within the cylinder, forward of the piston, is reciprocatingly driven by the piston due to successive over and under pressures in an air cushion formed within the cylinder between the piston and the ram. The ram repeatedly impacts a beat piece slideably located forward of the ram either within the cylinder or forward of the cylinder, which in turn transfers the forward impacts from the ram to the cutting tool releasably secured, for limited reciprocation, within the tool holder at the front of the rotary hammer. When a hammer drill only comprises a hammer strike mechanism, the hammer drill can only operate in a hammer only mode. An example of such a hammer is a pavement breaker. EP1872908 discloses such a pavement breaker.

Other types of hammer drill can operate in two modes of operation, namely a hammer only mode or a hammer and drill mode, or in three modes of operation, namely a hammer only mode, a drill only mode, or a hammer and drill mode. Hammer drills of these type typically comprise a hammer spindle mounted for rotation within a housing which can be selectively driven by a rotary drive mechanism within the housing. The rotary drive mechanism is driven by a motor also located within the housing. The hammer spindle rotatingly drives a tool holder of the rotary hammer which in turn rotatingly drives a cutting tool, such as a hammer bit or a drill bit, releasably secured within it. Within the hammer spindle is generally mounted a piston which can be reciprocatingly driven by a hammer drive mechanism which translates the rotary drive of the motor to a reciprocating drive of the piston. A ram, also slidably mounted within the hammer spindle, forward of the piston, is reciprocatingly driven by the piston due to successive over and under pressures in an air cushion formed within the hammer spindle between the piston and the ram. The ram repeatedly impacts a beat piece slidably located within the hammer spindle forward of the ram, which in turn transfers the forward impacts from the ram to the cutting tool releasably secured, for limited reciprocation, within the tool holder at the front of the rotary hammer. A mode change mechanism can selectively engage and disengage the rotary drive to the hammer spindle and/or the reciprocating drive to the piston. Thus, in the hammer only mode, there is only the reciprocating drive of the piston, in the drill only mode, there is only the rotary drive of the hammer spindle, and in the hammer and drill mode, there are both the rotary drive of the hammer spindle and the reciprocating drive of the piston. The specification of EP 0 975 454 al discloses a hammer drill which can operate in three modes of operation.

The hammer drive mechanisms for hammer drills comprise a conversion mechanism which converts the rotary movement of a drive shaft driven from the motor into a reciprocating movement of a rod which reciprocatingly drives the piston. Two designs of such a mechanism are typically employed.

The first type comprises a crank mechanism. A crank mechanism comprises a drive shaft on which is mounted an eccentric pin. Rotation of the drive shaft results in the eccentric pin rotating around the axis of rotation of the drive shaft, the eccentric pin moving in a circumferential direction around the axis. One end of a connecting rod attaches to the eccentric pin. The other end of the connecting rod attaches to the piston. The rotational movement of the eccentric pin around the axis of the crank shaft results in a reciprocating limited to a forward/rearward movement within the cylinder or spindle). The design and operation of such crank mechanisms is well known and therefore is not described movement of the piston within the cylinder or spindle (the movement of the piston being in any further detail. EP1872908 discloses a hammer drill having such a crank mechanism.

The second type comprises a wobble bearing. A wobble bearing comprises a wobble plate mounted on a drive shaft. A rod is attached to the side of the wobble plate and projects radially from the wobble plate. The wobble plate slideably engages with an angled groove or guide which is formed around the outer surface of the drive shaft and which extends in a plane, the plane being located at an angle to the longitudinal axis of the shaft. The wobble plate is prevented from rotating around the axis of the drive shaft. As such, rotation of the drive shaft causes the wobble plate to reciprocatingly drive the rod about an axis perpendicular to the longitudinal axis of the rod in a direction parallel to the axis of the drive shaft. The end of the rod remote from the wobble plate is attached to the piston. As such, the reciprocating movement of the arm results in a reciprocating movement of the piston. The design and operation of such wobble bearings is well known and therefore is not described in any further detail. EP1157788 discloses a hammer drill with a hammer drive mechanism comprising a wobble bearing.

A hammer cycle is when the drive shaft of a crank mechanism or a wobble bearing rotates through 360 degrees. During a hammer cycle, the piston will travel forward from its most rear position within a cylinder or spindle to its most forward position and then back again to its most rearward position. During a hammer cycle, the piston is driven forward in order to push the ram forward via an air cushion of increased air pressure to strike a beat piece which in turn strikes a cutting tool. The beat piece and ram subsequently rebound, with the ram then being drawn rearwardly by the piston which is moving in a rearward direction, due to a decrease in air pressure between the piston and the ram, to its rearmost position where the hammer cycle can commence again. The operation of hammer strike mechanisms is well known and therefore is not described in any further detail.

During a hammer cycle, different pressure loads are applied to the piston. This results in the torque applied by the drive shaft changing throughout a hammer cycle. The peak driving torque during a hammer cycle can be up to eight times higher than the overall average driving torque over a hammer cycle. This results in increased wear on component parts of the hammer strike mechanism and other component parts of the hammer drill.

SUMMARY

It is therefore the object of the present invention to reduce the peak loads of the drive torque throughout a hammer cycle to reduce the amount of variation of the drive torque experienced by component parts of the hammer strike mechanism. This will reduce the amount wear on the component parts. Furthermore, as the variation in drive torque over a hammer cycle is reduced, the size of the component parts of the hammer strike mechanism can be reduced.

Accordingly, there is provided a hammer drive mechanism in accordance with claim 1.

The use a dampener within a drive shaft of a hammer drive mechanism absorbs some of the energy when the peak driving torque is experienced by the hammer drive mechanism during a hammer cycle and subsequently releases it during other parts of the hammer cycle to smooth out the variation in the drive torque experienced by the hammer drive mechanism over a hammer cycle.

The dampener can be made from resiliently deformable material, or may be a mechanical spring or any other type of spring, such as a pneumatic spring, or material which exhibits spring like properties. The dampener may be a compound dampener made from a combination of individual dampeners. The dampening properties may be linear or variable over the range of angular positions of the two parts.

Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

Three embodiments of the present invention will now be described, by way of example only, with reference to the accompanying figures, in which.

DETAILED DESCRIPTION

A first embodiment of the present invention will now be described with reference to FIGS. 1 to 7.

Figure 1:
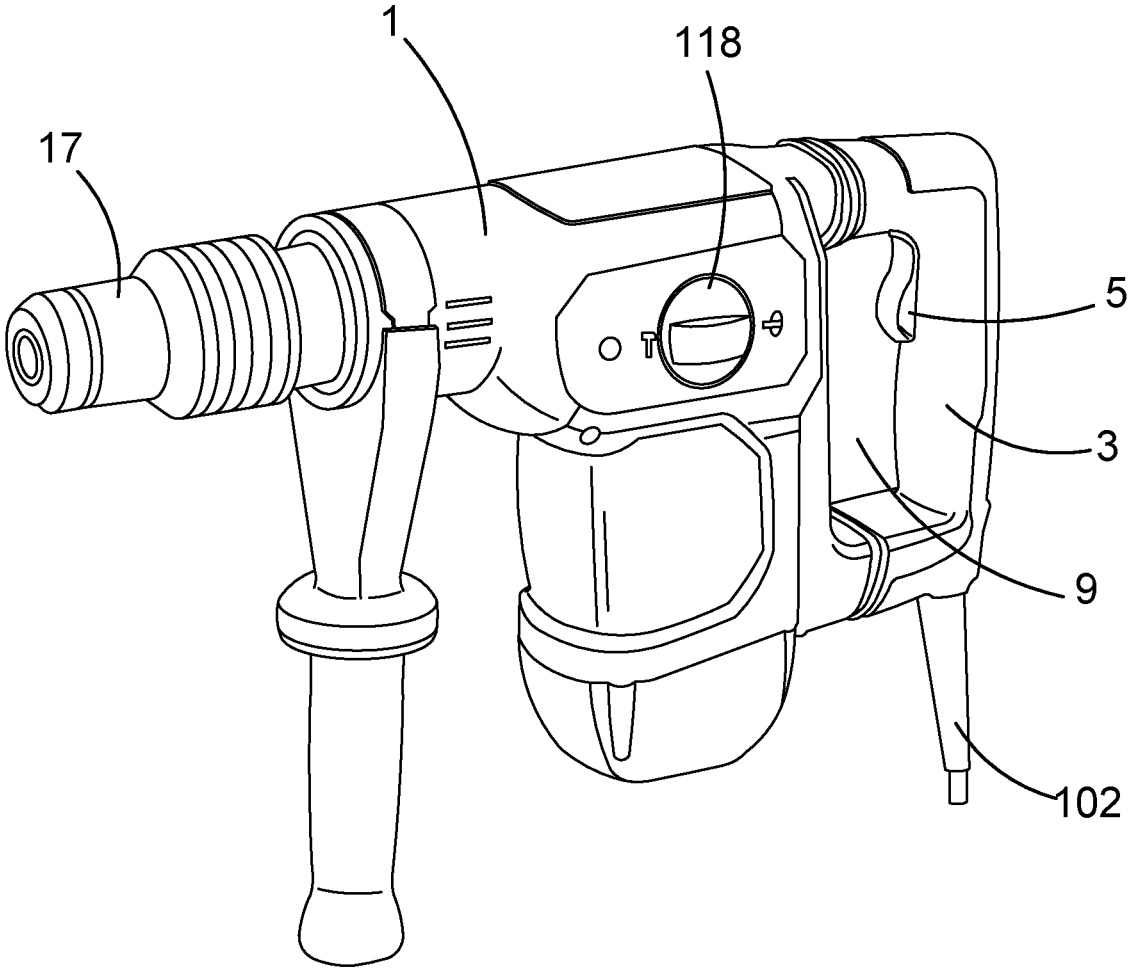
FIG. 1 shows a perspective view of a hammer drill.

A hammer drill is shown in FIG. 1. The represented rotary hammer has a hammer housing 1 which forms a gripping portion 3 at its rear end. A switch actuator 5 for switching an electric motor (not shown) of the hammer drill on and off projects into a grip opening 9. The grip opening 9 is defined at its rear side by the gripping portion 3. In the rear lower portion of the gripping portion 3, a mains lead 102 which serves to connect the hammer drill to a power source, is led out. It will however be appreciated that the hammer drill may be powered by a battery pack which attaches to the housing 1 or grip 3.

Figure 2:
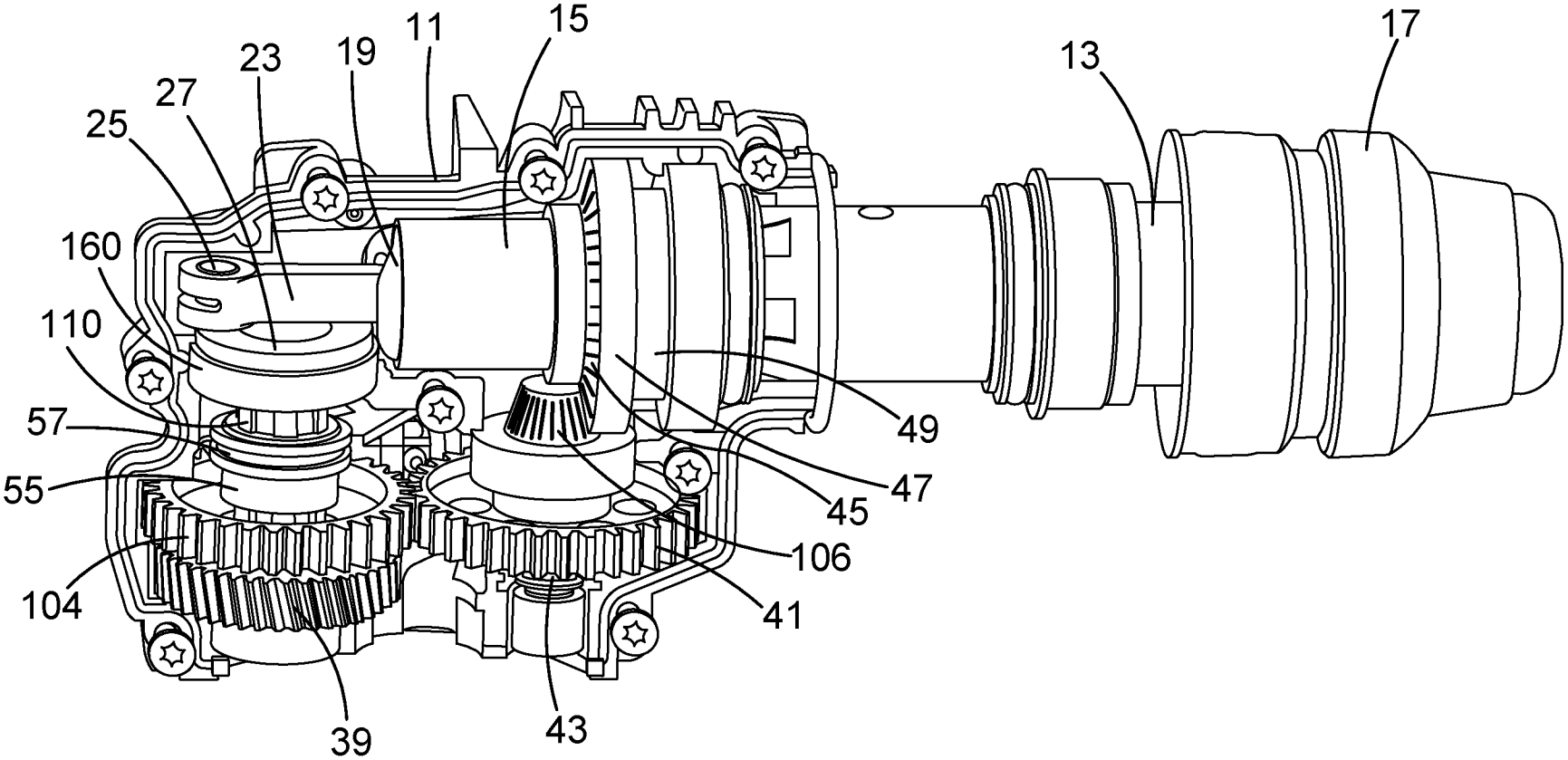
FIG. 2 shows a side view of the hammer strike mechanism with a crank mechanism and the rotary drive mechanism according to the first embodiment.
Figure 3:
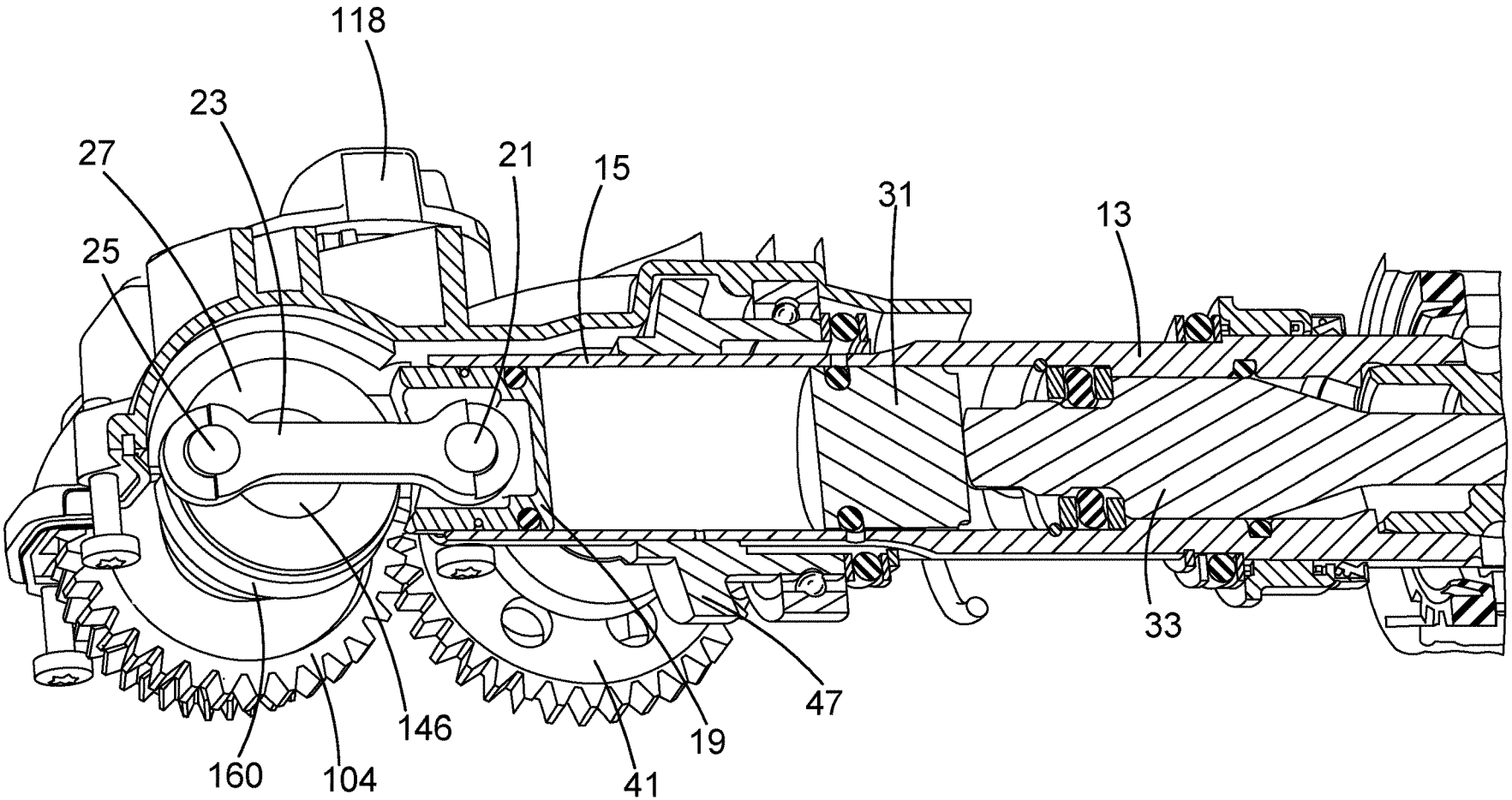
FIG. 3 shows a horizontal cross-sectional view of the hammer strike mechanism and rotary drive mechanism.
Figure 4:
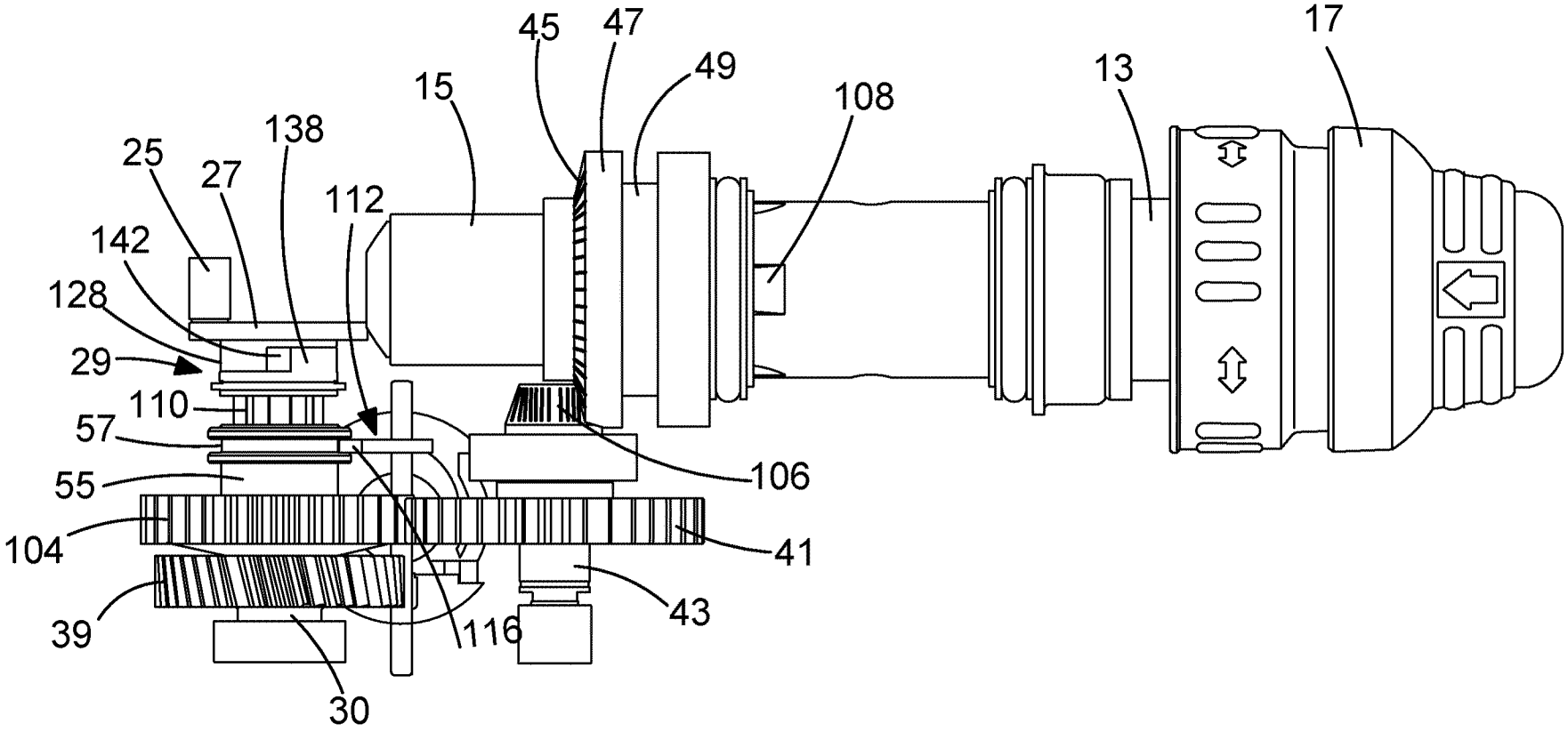
FIG. 4 shows a partial side view of the hammer strike mechanism and rotary drive mechanism with the two-part drive shaft being visible.

Located in the upper portion of the hammer drill shown in FIG. 1 is an inner housing 11, formed of half-shells and made from cast aluminium or the like in which a hammer spindle 13 is rotatably housed (see FIG. 2). The rear end of the hammer spindle 13 forms a guide tube 15, provided in known manner with vent apertures, for a pneumatic hammer strike mechanism, and at the front end of which a tool holder 17 is held. The hammer mechanism contains a piston 19 which is coupled, via a trunnion 21 housed in it and a connecting rod 23, with a rigid crank pin 25 which sits eccentrically on the upper plate-shaped end 27 of a two-part drive shaft 29 which is described in more detail later (see FIG. 3). A reciprocating movement of the piston 19 is carried out to alternately create a vacuum and an over-pressure in front of it, in order to move a ram 31 situated in the guide tube 15 correspondingly, so that this transmits impacts onto a beat piece 33, which passes them on to the rear end of a hammer bit, drill bit or chisel bit (not shown), which is inserted into the tool holder 17. This mode of operation and the structure of a pneumatic hammer strike mechanism are known and will therefore not be explained in more detail.

The electric motor is arranged in the hammer housing 1 in such a way that its armature shaft (not shown) extends substantially perpendicular to the longitudinal axis of the hammer spindle 13 and the tool holder 17. Also, the longitudinal axis of the armature shaft preferably lies in a plane with the longitudinal axis of the hammer spindle 13 and the tool holder 17.

To drive the hammer strike mechanism, at the upper end of the armature shaft, a pinion (not shown) is formed which meshes with a first gear wheel 39 rigidly mounted on a first rotatable shaft 30.

A second gear wheel 104 is mounted on the first rotatable shaft 30 in a freely rotatable but non-axially slideable manner.

The second gear wheel 104 meshes with a third gear wheel 41 rigidly mounted on a second rotatable shaft 43 in a non-rotatable manner. At the upper end of the second shaft 43, a bevel gear 106 meshes with the bevel teeth 45 of a drive sleeve 47. The drive sleeve 47 is rotatably mounted but axially non-displaceable on the hammer spindle 13 or on its rear part forming the guide tube 15 of the hammer mechanism. A coupling sleeve 49 is mounted in an axially displaceable but non-rotatable manner on the hammer spindle 13 in front of the drive sleeve 47 as a result of engagement with a splined section 108 on the outer surface of the hammer spindle 13. The coupling sleeve 49 can be displaced between a position of driving engagement, via teeth or projections (not shown) formed at its rear end, with corresponding teeth or projections (not shown) at the front end of the drive sleeve 47, and a forwardly displaced position in which there is no engagement between the coupling sleeve 49 and the drive sleeve 47. A helical spring (not shown) loads the coupling sleeve 49 in the direction of the drive sleeve 47. The spring loading causes the coupling sleeve 49 to be biased into the position of driving engagement with the drive sleeve 47. The coupling sleeve 49, the drive sleeve 47 and the spring act as a torque clutch which operates in the well-known manner.

Thus, rotation of the third gear wheel 41 causes rotation of the second shaft 43 which in turn causes rotation of the drive sleeve 47. And, when there is a positive engagement between drive sleeve 47 and the coupling sleeve 49, the hammer spindle 13 and the tool holder 17 are also rotated.

To drive the hammer strike mechanism, the first gear wheel 39 driven by the pinion of the armature shaft 35 is coupled with the drive shaft 29 in a manner yet to be described so that the crank pin 25 performs a circular movement which creates, via the connecting rod 23, the reciprocating movement of the piston 19 in the guide tube 15 of the hammer mechanism.

A sleeve-shaped coupling part 55 is non-rotatably mounted (through engagement with a splined section) but axially displaceable on the first shaft 30 and has an annular groove 57 formed around its periphery. At the lower end, the sleeve-shaped coupling part 55 has projections or teeth (not shown). In the lowest position of the sleeve-shaped coupling part 55 on the first shaft 30, the teeth are in positive engagement with corresponding recesses (not shown) in the second gear wheel 104. In this position, rotation of the first gear wheel 39 rotates the first shaft 30 which is in positive engagement with the sleeve-shaped coupling part 55, which in turn rotates the second gear wheel 104.

The drive shaft 29 is supported in a bearing 160 and is located in axial alignment with the first shaft 30. The lower end of the crank shaft 29 comprises a series of teeth 110. At its upper end, the sleeve-shaped coupling part 55 has a second set of projections or teeth (not shown). In the upper position of the sleeve-shaped coupling part 55 on the first shaft 30, the second set of teeth are in positive engagement with corresponding teeth 110 of the drive shaft 29. In this position, rotation of the first gear wheel 39 rotates the first shaft 30 which is in positive engagement with the sleeve-shaped coupling part 55, which in turn rotates the drive shaft 29.

The sleeve coupling part 55 can be axially slid, using a mode change mechanism 112, on the first shaft 30 between three positions, a first lower position where it is in driving engagement with the second gear wheel 104 but disengaged from the drive shaft 29, a second middle position where it is in driving engagement with the second gear wheel 104 and the drive shaft 29, and a third upper position where it is disengaged from the second gear wheel 104 but is drivingly engaged with the drive shaft 29. When the sleeve coupling part 55 is axially slid, to the first lower position, rotation of the first gear wheel 39 results in the operation of the rotary drive mechanism but no operation of the hammer strike mechanism (drill only mode). When the sleeve coupling part 55 is axially slid to the second middle position, rotation of the first gear wheel 39 results in the operation of both the rotary drive mechanism and the hammer strike mechanism (drill and hammer mode). When the sleeve coupling part 55 is axially slid to the third upper position, rotation of the first gear wheel 39 results in no operation of the rotary drive mechanism but the operation of the hammer strike mechanism (hammer only mode).

The mode change mechanism 112 moves the sleeve coupling part 55 by the vertical movement of a plate 116 using a mode change knob 118. Mode change mechanisms are well known in the art and therefore no further details will be described.

Figure 5A:
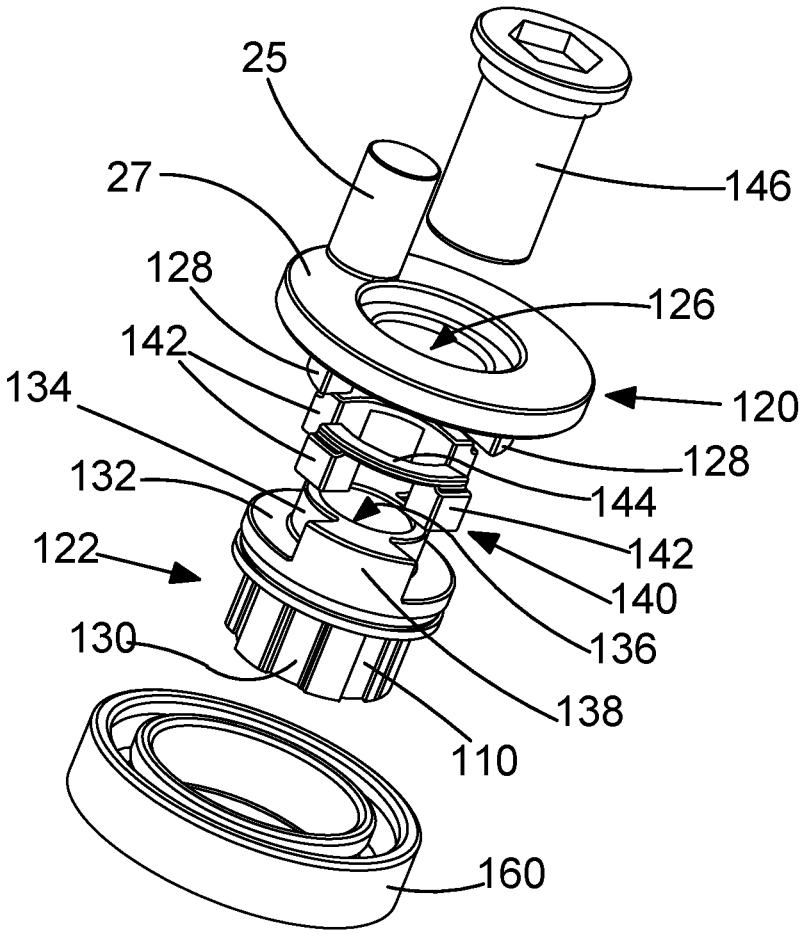
FIG. 5A shows an exploded view of the two-part drive shaft.
Figure 5B:
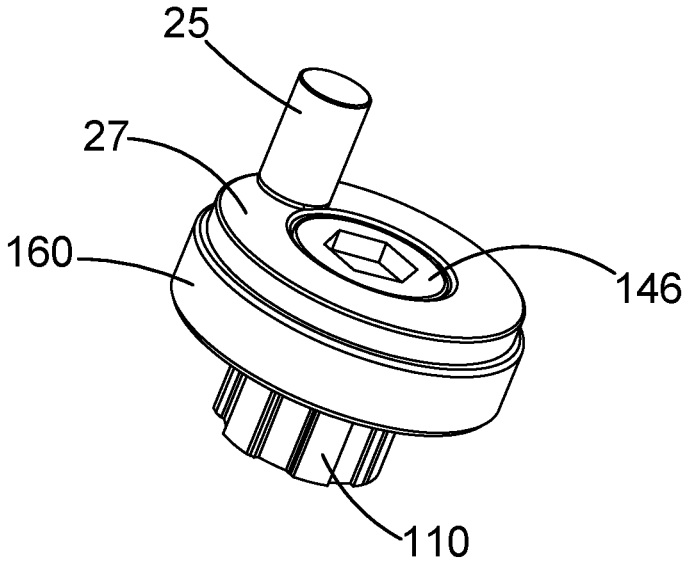
FIG. 5B shows a perspective view of the assembled two-part drive shaft.
Figure 6:
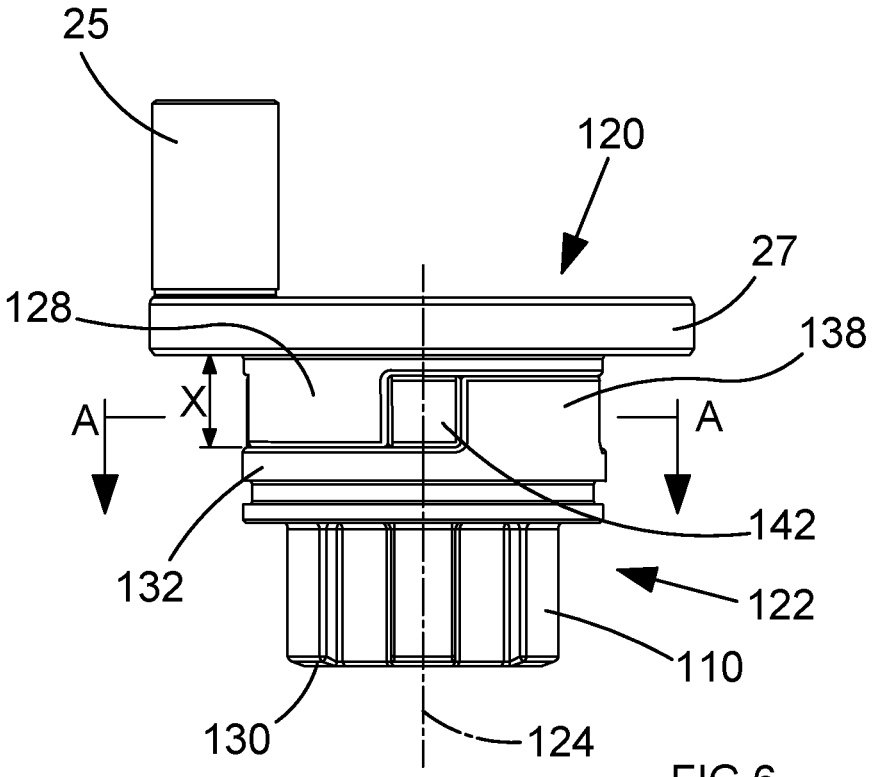
FIG. 6 shows a side view of the assembled two-part drive shaft.
Figure 7:
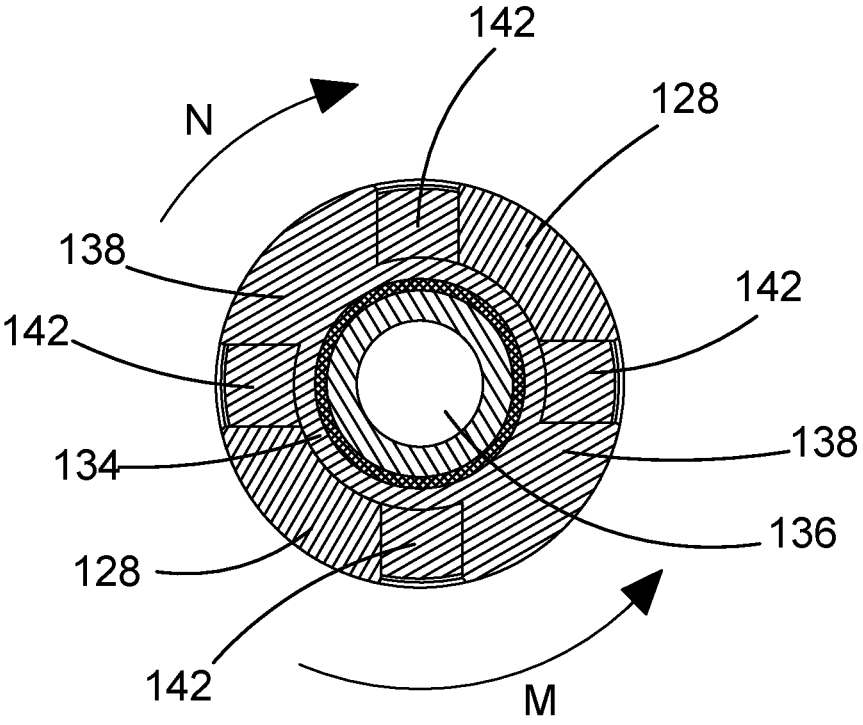
FIG. 7 shows a cross sectional view of the two-part drive shaft in the direction of Arrows A in FIG. 6.

The two-part drive shaft 29 will now be described in further detail with reference to FIGS. 5, 6 and 7.

The drive shaft 29 comprises two parts, a first rigid upper part 120 and a second rigid lower part 122.

The first upper part 120 comprises the upper plate-shaped end 27 on which is mounted the crank pin 25. The crank pin 25 is mounted eccentrically to the axis of rotation 124 of the drive shaft 29 and extends in a direction which is parallel to the axis 124 of rotation. A circular aperture 126 is formed through the upper plate-shaped end 27 in a symmetrical manner around the axis of rotation 124. Formed on the underside of the upper plate-shaped end 27 are two projections 128 (see FIG. 7). The two projections 128 have a uniform depth X and are of the same shape arranged in a symmetrical manner around the axis of rotation 124. The shape of the cross section of each projection is that of a trapezium where the two parallel sides are arcuate as best seen in FIG. 7. Each projection 128 extends circumferentially less than 90 degrees around the underside of the upper plate-shaped end 27 so that the gaps between the projections in a circumferential direction are greater in length than the length of the projections 128.

The second lower part 122, in a direction parallel to the direction of the axis of rotation 124, comprises three sections. The first lower section comprises a tubular body 130 on which are formed the teeth 110. The second middle section comprises a circular plate 132 which extends radially from the axis of rotation 124 in a symmetrical manner. The third section comprises a tubular extension 134 which surrounds the axis of rotation 124 in a symmetrical manner. The height of the tubular extension 134 is X. A tubular aperture 136 extends through the tubular extension 134 and circular plate 132 and into the tubular body 130. The tubular aperture 136 is threaded. Formed on the upper surface of the circular plate 132 are two projections 138. The sides of the projections 138 merge with the tubular extension 134. The two projections 138 also have a uniform depth X and are of the same shape arranged in a symmetrical manner around the axis of rotation 124. The shape of the cross section of each projection 138 is that of a trapezium where the two parallel sides are arcuate as best seen in FIG. 7. Each projection 138 extends circumferentially less than 90 degrees around the top surface of the circular plate 132 so that the gaps between the projections 138 in a circumferential direction are greater in length than the length of the projections 138.

Sandwiched between the two parts 120, 122, when the two parts are assembled, are two dampeners 140 made from resilient deformable material such as rubber. Each dampener 140 comprises two square pegs 142 interconnected with an arcuate tether 144 formed in a one-piece construction. The height of the square pegs 142 is X.

When the drive shaft 29 is assembled, the upper part 120 is placed on top of the lower part 122 so that the projections 128 on the upper part 120 are located between the projections 138 on the lower part 122 in an alternate manner. The two dampeners 140 are sandwiched between the two parts 120, 122 so that each square peg 142 of the dampeners 140 locates between a projection 128 from the upper part 120 and a projection 138 of the lower part so that adjacent projections 128, 138 are separated by a square peg 142. The size of the cross section of each square peg 142 is such to fill the gap between each pair of adjacent projections 128, 138. When the drive shaft 29 is assemble, the projections 128, 138 are arranged on a circular path around the axis of rotation 124 of the drive shaft (29 in the alternate manner. When no rotational torque is applied on the drive shaft 29, the projections 128, 138 and square pegs 142 are arranged in a symmetrical manner around the axis of rotation 124 as shown in FIG. 7.

A bolt 146 passes through the circular aperture 126 formed through the upper plate-shaped end 27 and screws into the threaded tubular aperture 136 sufficiently tightly to hold the upper and lower parts 120, 122 together whilst enabling the upper part 120 to rotate (Arrows M and N) about the axis of rotation 124 relative to the lower part 122, two of the square pegs 142 being compressed as it does so.

During the operation of the hammer strike mechanism, the lower part 122 of drive shaft 29 is rotationally driven about the axis of rotation 124 via the teeth 110. The lower part 122 transfers the rotary movement to the upper part 120 via the projections 138 of the lower part 122 transferring the rotational force via the square pegs 142 of the dampener 140 to the projections 128 on the upper part 120 which in turn transfers the rotational force to the crank pin 25.

During the hammer cycle the force exerted on the piston 19 and hence on the crank pin 25 changes. As the force changes, the rotational torque transferred across the dampeners 140 changes. The compression of the dampeners 140 allow limited rotational movement (Arrows M and N) between the upper part 120 and lower part 122 due to the compression and expansion of the square pegs 142 between the projections 128, 138 as the upper part 120 moves relative to the lower part 122. The compression and expansion of the square pegs 142 of the dampeners 140 absorbs, across a hammer cycle, some of the variation in the torque experienced in the hammer drive mechanism.

When no rotational torque is applied on the drive shaft 29, it can be arranged that the square pegs 142 experience no compressive force, two of the square pegs 142 becoming more compressed when there is limited rotational movement (Arrows M and N) between the upper part 120 and lower part 122. Alternatively, when no rotational torque is applied on the drive shaft 29, it can be arranged that the square pegs 142 already compressed, two of the square pegs 142 becoming more compressed when there is limited rotational movement (Arrows M and N) between the upper part 120 and lower part 122, the other two becoming less compressed.

Whist the dampener in the first embodiment is made from a resiliently deformable material, it will be appreciated by reader that the dampener could be manufactured as a mechanical spring. It will further be appreciated that the dampener can be a combination of individual dampeners.

Figure 8:
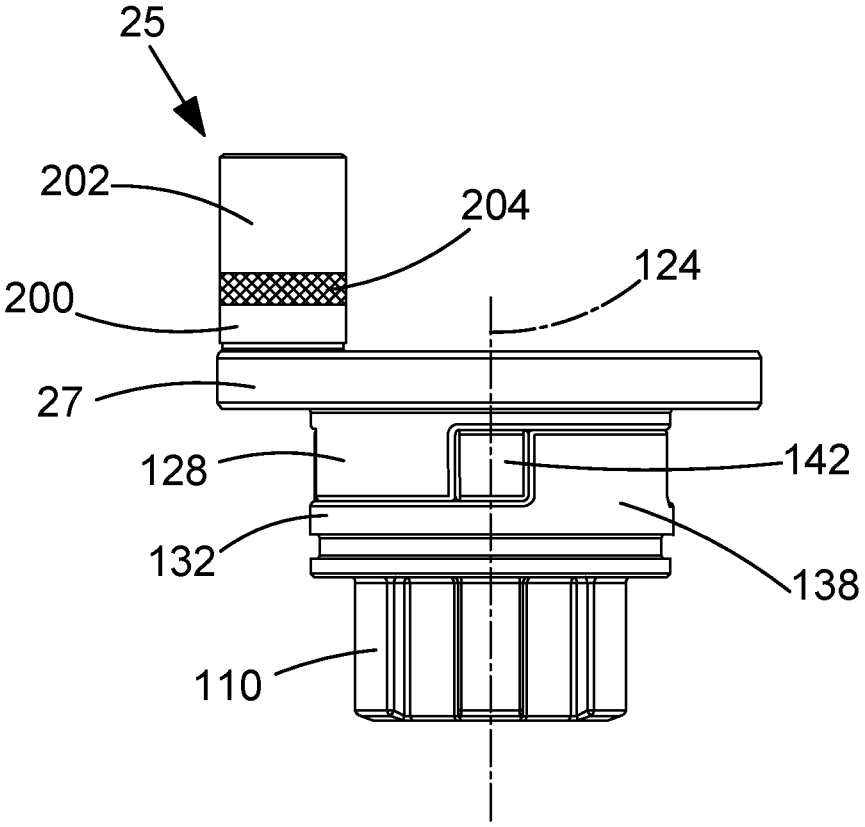
FIG. 8 shows a side view of the assembled two-part drive shaft of a crank mechanism according to a second embodiment of the present invention.

A second embodiment of the present invention will now be described with reference to FIG. 8. Where the same features are present in the second embodiment are present in the first embodiment, the same reference numbers have been used. The only difference between the first embodiment and the second embodiment is that the design of the crank pin 25. In the first embodiment, the crank pin 25 was made from a single rigid material such as steel. In the second embodiment, the crank pin is made from two parts, a first part 200 which is rigidly mounted on the upper plate-shaped end 27 and a second part 202 which attaches to the end of the connecting rod 23. The first and second parts 200, 202 are connected to each other by a dampener 204 made from a resilient deformable material.

During the hammer cycle the force exerted on the piston 19 and hence on the second part 202 of the crank pin 25 changes. As the force changes, the dampener 204 compresses and expands, absorbing some of the variation in the torque experienced in the hammer drive mechanism.

In the second embodiment, the design of the crank pin comprising two parts 200, 202 is shown being using in conjunction with the two-part drive shaft 29 comprising dampeners 140. It will be appreciated that the design of the crank pin comprising two parts 200, 202 can be used on its own with a drive shaft comprising a single component with no dampeners and still absorbing some of the variation in the torque experienced in the hammer drive mechanism over a hammer cycle.

Figure 9:
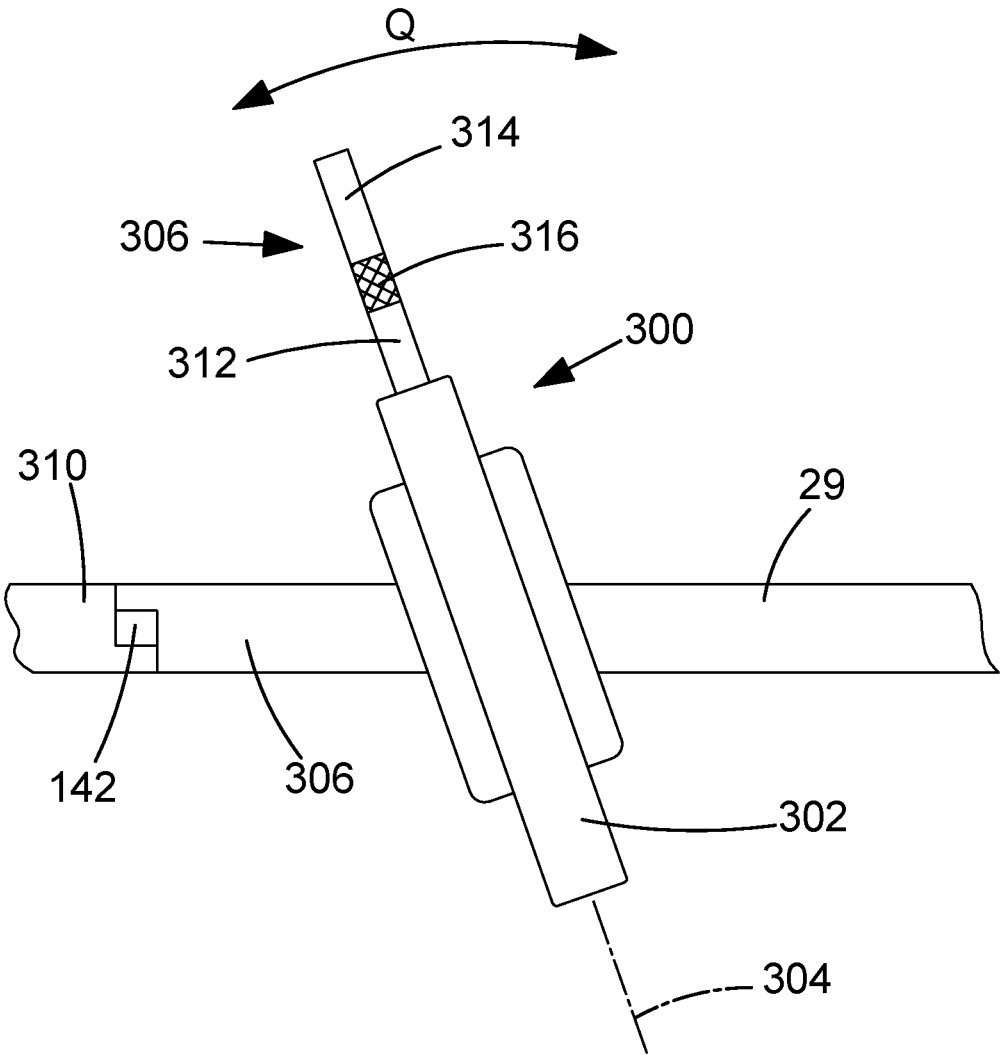
FIG. 9 shows a side view of the assembled two-part drive shaft of a wobble bearing according to a third embodiment of the present invention.

A third embodiment of the present invention will now be described with reference to FIG. 9. Where the same features are present in the third embodiment are present in the first embodiment, the same reference numbers have been used. The only difference between the first embodiment and the third embodiment is that the conversion mechanism is a wobble bearing 300.

The wobble bearing 300 comprises a wobble plate 302 which slideably engages, using ball bearings (not shown) with an angled groove (not shown) which is formed in the surface of the drive shaft and extends around the circumference of the drive shaft 29. The groove locates within in a plane 304, the plane 304 being located at an angle to the longitudinal axis of the shaft 29. A rod 306 is attached to the side of the wobble plate and projects radially from the wobble plate 302. The wobble plate is prevented from rotating around the axis of the drive shaft 29. As such, rotation of the drive shaft 29 causes the wobble plate 302 to reciprocatingly drive the rod about an axis perpendicular to the longitudinal axis of the rod 306 in a direction (Arrow Q) parallel to the axis of the drive shaft. The design of wobble bearings is well known and therefore no further design details are provided.

The drive shaft is constructed in two parts 308, 310 with dampeners 140 sandwiched between them. The design of the connecting portions of the two parts 308, 310 and the dampeners 140 are the same as those in the first embodiment and function in the exact same manner.

The design of the rod 306 is made from two parts, a first part 312 which is rigidly mounted on wobble plate 302 and a second part 314 which connects to the piston. The first and second parts 312, 314 are connected to each other by an dampener 316 made from a resilient deformable material.

During the hammer cycle the force exerted on the piston 19 and hence on the second part 314 of the rod 306 changes. As the force changes, the dampener 316 compresses and expands, absorbing some of the variation in the torque experienced in the hammer drive mechanism.

In the third embodiment, the design of the rod 306 is shown as comprising two parts 312, 314 joined by a dampener 316. It will be appreciated that the design of the rod 306 could comprise a single component with no dampeners, the drive shaft 29 with dampeners 140 still absorbing some of the variation in the torque over a hammer cycle experienced in the hammer drive mechanism.

It will be appreciated by persons skilled in the art that the above embodiments have been described by way of example only and not in any limitative sense, and that various alterations and modifications are possible without departure from the scope of the invention as defined by the appended claims.

Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The invention claimed is:

1. A hammer drive mechanism for a hammer strike mechanism of a hammer drill comprising:

a drive shaft rotationally driven by a motor;

a rod configured to reciprocatingly drive a piston; and a conversion mechanism configured to convert a rotary movement of the drive shaft into a reciprocating movement of the rod, wherein the drive shaft comprises a first part connected to the conversion mechanism and a second part rotationally driven by the motor, the second part connecting to the first part via at least one dampener such that a rotary movement of the second part is transferred to the first part via the at least one dampener.

2. The hammer drive mechanism of claim 1, wherein at least one of the at least one dampener comprises resiliently deformable material.

3. The hammer drive mechanism of claim 1, wherein at least one of the at least one dampener comprises a mechanical spring.

4. The hammer drive mechanism of claim 1, wherein the conversion mechanism is a crank mechanism.

5. The hammer drive mechanism of claim 4, wherein:

the crank mechanism comprises a crank pin mounted eccentrically on the first part of the drive shaft, one end of the rod is pivotally attached to the crank pin, and the rod extends away from the crank pin in a direction that is perpendicular to an axis of rotation of the drive shaft.

6. The hammer drive mechanism of claim 5, wherein the crank pin comprises a first part mounted eccentrically on the first part of the drive shaft and a second part attaches to the end of the rod, and wherein the first and second parts of the crank pin are connected to each other by a second dampener.

7. The hammer drive mechanism of claim 1, wherein the conversion mechanism comprises a wobble bearing.

8. The hammer drive mechanism of claim 7, wherein the wobble bearing comprises a wobble plate rotationally mounted on the drive shaft, wherein the rod is rigidly connected to and extends radially away from the wobble plate.

9. The hammer drive mechanism of claim 8, wherein the rod comprises two parts joined by a second dampener.

10. The hammer drive mechanism of claim 1, wherein:

the first part of the drive shaft comprises at least one first projection such that rotation of the first part results in rotation of the at least one first projection, the second part of the drive shaft comprises at least one second projection such that rotation of the second part results in rotation of the at least one second projection towards the at least one first projection, and at least a part of the at least one dampener is located between the first and second projections to transfer the rotary movement of the at least one second projection to the at least one first projection.

11. The hammer drive mechanism of claim 10, wherein:

the at least one first projection comprises a plurality of first projections;

the at least one second projection comprises a plurality of second projections;

the number of the plurality of first projection and the plurality of second projections are equal;

the pluralities of first and second projections are arranged on a circular path around an axis of rotation of the drive shaft;

each of the plurality of first projections on the first part is located between two of the plurality of second projections on the second part and each of the plurality of second projections on the second part is located between two of the plurality of first projections on the first part so that the pluralities of first and second projections are arranged alternatingly around the axis; and the at least part of the at least one dampener is located between at least one of the plurality of first projections and an adjacent one of the plurality of second projections.

12. The hammer drive mechanism of claim 10, wherein, when no rotary torque is applied to the drive shaft, the at least part of the at least one dampener located between the first and second projections fills a gap between the first and second projections without being compressed.

13. The hammer drive mechanism of claim 10, wherein, when no rotary torque is applied to the drive shaft, the at least part of the at least one dampener located between the first and second projections is compressed.

14. The hammer drive mechanism of claim 10, wherein the at least one dampener comprises two square pegs interconnected with an arcuate tether formed in a one-piece construction, the square pegs forming the at least part of the at least one dampener located between the first and second projections.

15. The hammer drive mechanism of claim 1, wherein the at least one dampener comprises two square pegs interconnected with an arcuate tether formed in a one-piece construction.

16. The hammer drive mechanism of claim 1, wherein the rod comprises a first part connected to the conversion mechanism and a second part connectable to a piston.

17. A hammer drill comprising:

a housing;

a motor having a shaft;

a tool holder provided at a front end of the housing capable of holding a cutting tool; and a hammer strike mechanism provided in the housing for generating impacts acting on a rear end of the cutting tool, the hammer strike mechanism comprising:

a guide tube mounted in the housing;

a hammer drive mechanism according to claim 1, wherein the motor is capable of rotatingly driving the drive shaft of the hammer drive mechanism;

a piston mounted in the guide tube in an axially slideable manner and being reciprocatingly driven by the rod;

a ram mounted in the guide tube in an axially slideable manner and being reciprocatingly driven by the piston via an air cushion formed within the guide tube between the piston and ram;

wherein the reciprocating ram impacts the rear end of the cutting tool.

18. The hammer drill of claim 17, wherein the hammer strike mechanism further comprises a beat piece mounted within the housing between the ram and the tool holder, the ram impacting the rear of the cutting tool via the beat piece.

19. The hammer drill of claim 17, wherein the guide tube is formed by at least part of a spindle rotationally driven by the motor, wherein the tool holder is connected to the front of the spindle so that rotation of the spindle results in rotation of the tool holder.

20. A hammer drive mechanism for a hammer strike mechanism of a hammer drill comprising:

a drive shaft rotationally driven by a motor;

a rod reciprocatingly driving a piston; and a conversion mechanism arranged to convert the rotary movement of the drive shaft into a reciprocating movement of the rod, wherein the conversion mechanism comprises a crank mechanism having a crank pin mounted eccentrically on a first part of the drive shaft, an end of the rod being pivotally attached to the crank pin, wherein the rod extends away from the crank pin in a direction that is perpendicular to an axis of rotation of the drive shaft, wherein the crank pin comprises a first part mounted eccentrically on the first part of the drive shaft and a second part attaches to the end of the connecting rod, and wherein the first and second parts of the crank pin are connected to each other by a dampener.

* * * * *